US012201886B2

(12) United States Patent
Coulter et al.

(10) Patent No.: US 12,201,886 B2
(45) Date of Patent: Jan. 21, 2025

(54) HYBRID FITNESS LADDER

(71) Applicant: DICK'S Sporting Goods, Inc., Coraopolis, PA (US)

(72) Inventors: Derek Coulter, Sewickley, PA (US); Tyler Crow, Bethel Park, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 144 days.

(21) Appl. No.: 18/057,068

(22) Filed: Nov. 18, 2022

(65) Prior Publication Data

US 2023/0158390 A1 May 25, 2023

Related U.S. Application Data

(60) Provisional application No. 63/264,323, filed on Nov. 19, 2021.

(51) Int. Cl.
*A63B 71/02* (2006.01)

(52) U.S. Cl.
CPC ..... *A63B 71/03* (2020.08); *A63B 2210/50* (2013.01)

(58) Field of Classification Search
CPC ..... A63B 71/03; A63B 2210/50; A63B 5/22; A63B 2209/14; A63B 2225/09; A63B 71/0036; A63B 2209/10; A63B 2209/00; G09B 19/0038
See application file for complete search history.

(56) References Cited

U.S. PATENT DOCUMENTS 2,042,764 A * 6/1932 Birch ..... A63B 22/001 482/52
2,206,501 A * 7/1940 Gill ..... A63K 3/043 482/17
2,706,631 A * 4/1955 Holmes ..... A63K 3/043 482/17
3,514,062 A * 5/1970 Gordon ..... A63B 5/02 482/16
3,547,435 A 12/1970 Scott
3,598,406 A 8/1971 Robinson
4,059,268 A * 11/1977 Forrest ..... A63B 69/0028 473/440
4,475,628 A * 10/1984 Heilskov ..... E06C 1/56 182/138

(Continued)

OTHER PUBLICATIONS

Caswick Modular Ladder (Year: 2013).*
Caswick Modular Ladder WRC Certification (Year: 2021).*

*Primary Examiner* — Garrett K Atkinson
(74) *Attorney, Agent, or Firm* — Foley & Lardner LLP

(57) ABSTRACT

A hybrid fitness ladder including at plurality of rung units, along with a rung unit for such a ladder, are described. Each one rung unit includes a plurality of elevated rails as well as a plurality of ground rails, wherein each ground rail is integrated or connected to at least one elevated rail. The hybrid fitness ladder may further include at least one rung unit connector configured to removably attach one rung unit to another rung unit in positions where the elevated rails are positioned as ladder rungs, in positions where the ground rails are positioned as ladder rungs, or a combination of the two. The elevated rails and ground rails may be made of a semi-flexible material that is deformable and biased toward a first configuration.

21 Claims, 11 Drawing Sheets

(56) References Cited

U.S. PATENT DOCUMENTS 4,666,147 A * 5/1987 Warman ..... A63B 5/10 182/115
4,822,029 A 4/1989 Sarno et al.
4,842,798 A * 6/1989 Mott ..... A63B 49/10 249/176
4,848,737 A 7/1989 Ehrenfield
5,152,727 A * 10/1992 Moore ..... A63K 3/043 239/289
5,328,422 A 7/1994 Nichols
5,334,121 A * 8/1994 McPhilomy ..... A63K 3/043 482/17
5,490,818 A 2/1996 Haber et al.
D369,390 S 4/1996 Haber et al.
5,605,205 A * 2/1997 Douglas ..... E06C 1/56 182/198
5,746,287 A * 5/1998 Durham, Jr. ..... A62B 5/00 182/196
5,971,105 A * 10/1999 Jacobson ..... E06C 1/56 182/198
6,063,005 A * 5/2000 Schwartz ..... A63K 3/043 482/16
6,079,072 A 6/2000 Katsiri
6,375,601 B1 * 4/2002 Johnson ..... A61H 1/0292 482/142
6,447,427 B1 * 9/2002 Myrland ..... E06C 1/56 482/14
6,475,116 B2 * 11/2002 Chen Wu ..... A63K 3/043 482/17
6,889,982 B1 * 5/2005 Gove ..... A63B 63/00 273/400
6,955,631 B2 * 10/2005 Chen Wu ..... A63B 23/0464 482/52
7,481,741 B1 * 1/2009 Sammann ..... A63B 9/00 482/37
7,699,756 B2 * 4/2010 Piane, Jr. ..... A63B 1/00 248/222.52
8,317,661 B2 * 11/2012 Wight ..... A63B 23/0464 482/37
8,328,696 B2 * 12/2012 Dieter ..... A63B 23/0464 482/14
8,579,768 B2 11/2013 Prstojevich
8,852,058 B1 * 10/2014 Hamberis ..... A63F 9/24 482/44
9,017,224 B1 4/2015 Singley
9,039,575 B2 * 5/2015 Holland ..... A63K 3/043 482/17
9,186,534 B2 * 11/2015 Bollers ..... A63B 5/22
9,333,383 B1 * 5/2016 Barton ..... A63B 23/03525
9,468,803 B2 10/2016 Tani
9,675,830 B2 * 6/2017 Holland ..... A63B 69/00
10,300,338 B2 * 5/2019 Chen ..... A63B 26/003
10,369,402 B2 * 8/2019 Sotis ..... A63B 22/00
10,758,777 B2 * 9/2020 Kitazawa ..... A61H 5/00
11,154,739 B2 * 10/2021 Kistner ..... A63B 21/4034
11,890,497 B2 * 2/2024 Holland ..... A63B 17/00
2005/0082761 A1 * 4/2005 Lynch ..... A63B 67/10 273/343
2006/0229171 A1 10/2006 Severino
2006/0247100 A1 11/2006 Harker
2008/0020903 A1 * 1/2008 Dieter ..... A63B 5/22 482/51
2010/0203780 A1 * 8/2010 Hobbs ..... A61G 1/013 441/80
2010/0298074 A1 * 11/2010 Esposito ..... A63B 69/00 473/438
2011/0166000 A1 * 7/2011 Wight ..... A63B 23/0464 482/17
2012/0077644 A1 3/2012 Dieter
2014/0287878 A1 * 9/2014 Holland ..... A63B 5/22 482/17
2015/0060204 A1 * 3/2015 Walter ..... E06C 7/08 182/163
2015/0099609 A1 * 4/2015 White ..... A63B 71/03 482/23
2015/0224379 A1 * 8/2015 Holland ..... E06C 1/52 482/51
2016/0296801 A1 10/2016 De La Garza et al.
2017/0246505 A1 * 8/2017 Rains ..... A63B 17/00
2018/0056115 A1 * 3/2018 Sotis ..... A63B 5/22
2018/0133534 A1 5/2018 Lagree
2019/0111296 A1 * 4/2019 Jacob ..... A63B 17/04
2019/0321674 A1 * 10/2019 Holland ..... A63K 1/00
2022/0288437 A1 * 9/2022 Geissler ..... A63B 21/16

* cited by examiner

HYBRID FITNESS LADDER

CLAIM OF PRIORITY

This patent document claims priority to U.S. Provisional Application No. 63/264,323, filed on Nov. 19, 2021, the disclosure of which is incorporated herein by reference in its entirety.

BACKGROUND

Agility ladders and raised ladders are typically used to help athletes perform training exercises. For example, an agility ladder may be used to allow a user to develop speed and agility by performing footwork drills, where the user steps in and out of the space between the rungs of the ladder in quick succession. As another example, raised ladders can allow a user to develop lower body power by performing hurdle drills, where the user jumps over the heightened rungs of the ladder.

These training exercises or drills can be used to train various athletic skills such as, for example, control, speed, agility, coordination and/or the like. However, raised ladders and agility ladders are typically two distinct devices. Some "two-in-one" devices combine elements of raised ladders with those of agility ladders by allowing a user to raise and lower the rungs of the ladder to switch between a raised and agility configuration. However, these devices typically cannot be disassembled so that elements of the ladder can be used in different drills or exercises. In addition, these devices are typically configured to maintain a linear shape, which limits the variety of drills that can be performed using the device.

This document describes assemblies that are directed to addressing the problems described above, and/or other issues.

SUMMARY

In one aspect, the present disclosure relates to a hybrid fitness ladder that includes a plurality of rung units. Each rung unit includes a plurality of elevated rails and a plurality of ground rails. Each ground rail is integrated with or connected to at least one of the elevated rails. The ladder also includes at least one rung unit connector having a first end and a second end. The first end of each rung unit connector is configured to separably connect to a respective first one of the rung units, and the second end of each rung unit connector is configured to separably connect to a respective next one of the rung units.

Optionally, any of the elevated rails may include a first support member, a second support member, and an elongated portion that extends between the first support member and the second support member. The elongated portion is supported in an elevated position by the first support member and the second support member.

Optionally, any of the ground rails may include a first end, a second end, and an elongated portion that extends between the first end and the second end of the ground rail. At least a portion of the elongated portion of the ground rail is configured to contact a surface on which the hybrid fitness ladder is positioned.

In any of the embodiments above, the elevated rails of each rung unit comprise a first elevated rail and a second elevated rail, the ground rails of each rung unit comprise a first ground rail and a second ground rail, the first and second elevated rails of each rung unit are substantially parallel to each other and define a first and second side of the rung unit, and the first and second ground rails of each rung unit are substantially parallel to each other and define a third and a fourth side of the rung unit.

In any of the embodiments above, for each rung unit: (i) the elevated rails of the rung unit comprise a first elevated rail and a second elevated rail; (ii) the ground rails of the rung unit comprise a first ground rail and a second ground rail; (iii) the first support member of the first elevated rail is connected to a first end of the first ground rail to form a first corner of the rung unit; (iv) the second support member of the first elevated rail is connected to a first end of the second ground rail to form a second corner of the rung unit; (v) the first support member of the second elevated rail is connected to a second end of the first ground rail to form a third corner of the rung unit; and (vi) the second support member of the second elevated rail is connected to a second end of the second ground rail to form a fourth corner of the rung unit.

In any of the embodiments above, each rung unit may include a plurality of fastener elements configured to attach to a rung unit connector. Optionally, each of the rung unit connectors may be configured to removably and rotatably connect to at least one of the plurality of rung units. Optionally, a first of the rung units may be connected to a second of the rung units by two of the rung unit connectors, the two rung unit connectors may connect to the first rung unit at different corners of a same side of the first rung unit, and the two rung unit connectors connect to the second rung unit at different corners of a same side of the second rung unit.

In any of the embodiments above, a plurality of the rung units may be connected in series, with two rung unit connectors positioned between each pair of rung units of the plurality of rung units.

In any of the embodiments above, each of the elevated rails has an I-beam shaped cross-section.

In any of the embodiments above, each of the plurality of ground rails has an I-beam shaped cross-section.

In any of the embodiments above, the elevated rails and ground rails are removably attached to one another such that the ground rails and elevated rails are reconfigurable with respect to one another.

In another aspect, this disclosure describes a rung unit for a hybrid fitness ladder, the rung unit comprising a plurality of ground rails and a plurality of elevated rails. Each elevated rail includes an elongated portion that is elevated with respect to each of the ground rails. Each of the ground rails is integrated with or connected to a first of the elevated rails at a first and to a second of the elevated rails at a second end. The elevated rails are made of a semi-flexible material that is deformable and biased toward a configuration in which the elevated rails are supported in an elevated position.

Optionally, each elevated rail of the above-described rung unit comprises a first support member, a second support member, and the elongated portion. The elongated portion may extend between the first end portion and the second end portion.

Optionally, the plurality elevated rails of the rung unit comprise a first elevated rail and a second elevated rail, the ground rails comprise a first ground rail and a second ground rail, the first and second elevated rails are substantially parallel to each other and define a first and second side of the rung unit, and the first and second ground rails are substantially parallel to each other and define a third and a fourth side of the rung unit.

Optionally, in the rung unit: (i) each of the elevated rails may comprise a first support member and a second support member that support the elongated portion in an elevated position; (ii) the first support member of a first of the elevated rails is connected to a first end of a first of the ground rails to form a first corner of the rung unit; (iii) the second support member of the first elevated rail is connected to the first end of a second of the ground rails to form a second corner of the rung unit; (iv) the first support member of a second of the elevated rails is connected to a second end of the first ground rail to form a third corner of the rung unit; and (v) the second support member of the second elevated rail is connected to a second end of the second ground rail to form a fourth corner.

Optionally, the rung unit also may comprise a plurality of fastener elements, each of which is configured to attach to a rung unit connector.

Other embodiments are directed to a hybrid fitness ladder comprising a plurality of any of the rung unit embodiments described above, wherein each rung unit is connected to another rung unit by at least one rung unit connector. In such a hybrid fitness ladder, each rung unit connector may be configured to removably and rotatably connect to at least one of the rung units such that either the ground rails or the elevated rails of each of the rung unit may be positioned to be rungs of the ladder. A first rung unit may be connected to a second rung unit by two rung unit connectors, the two rung unit connectors may connect the first rung unit at different corners of a same side of the first rung unit, and the two rung unit connectors may connect the second rung unit at different corners of a same side of the second rung unit.

BRIEF DESCRIPTION OF THE DRAWINGS

The accompanying drawings, which are incorporated herein and constitute part of this specification, are illustrative of particular embodiments of the present disclosure and do not limit the scope of the present disclosure.

DETAILED DESCRIPTION

The following discussion omits or only briefly describes conventional features of the disclosed technology that are apparent to those skilled in the art. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations. A person of ordinary skill in the art would know how to use the instant invention, in combination with routine experiments, to achieve other outcomes not specifically disclosed in the examples or the embodiments.

It is also to be understood that the terminology used in the description is for the purpose of describing the particular versions or embodiments only and is not intended to limit the scope of the present disclosure which will be limited only by the appended claims. Unless otherwise specifically defined herein, all terms are to be given their broadest possible interpretation including meanings implied from the specification as well as meanings understood by those skilled in the art and/or as defined in dictionaries, treatises, etc. Unless defined otherwise, all technical and scientific terms used herein have the same meanings as commonly understood by one of ordinary skill in the art. Although any methods, equipment, and materials similar or equivalent to those described herein can be used in the practice or testing of embodiments of the present disclosure, the preferred methods, devices, and materials are now described. All references mentioned herein are incorporated by reference in their entirety.

The present disclosure generally relates to a hybrid ladder that includes features of an agility ladder (e.g., ground rails) and features of a raised ladder (e.g., elevated rails). The hybrid ladder of the present disclosure allows for the use of either the ground rails or the elevated rails to be used as ladder rungs for training purposes. Additionally, it is possible to train using a combination of ground rails and elevated rails as ladder rungs for training purposes.

Figure 1:
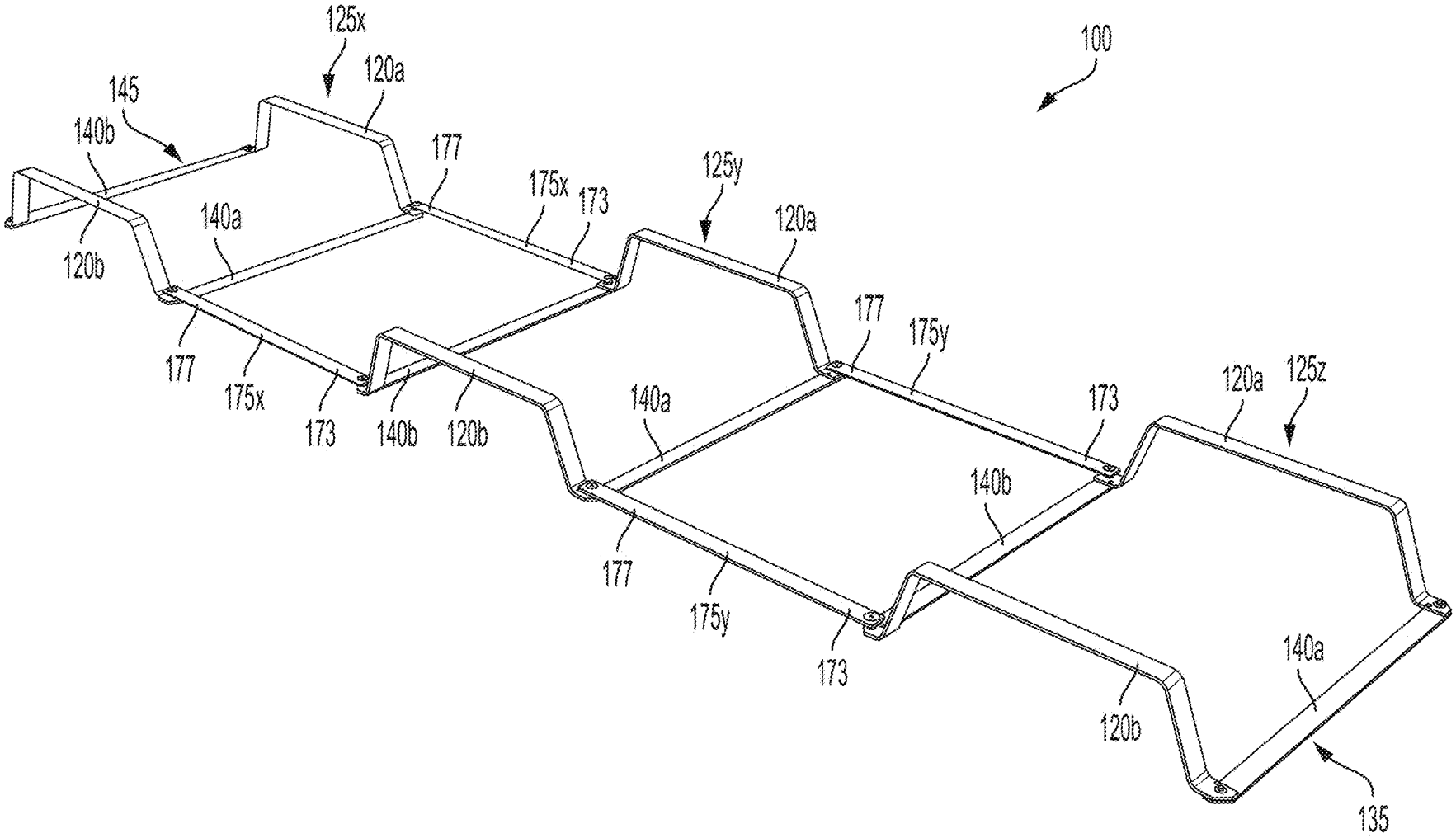
FIG. 1 is a perspective view of an example hybrid ladder in a first configuration in which segments of the side rails are elevated with respect to the rungs.
Figure 2A:
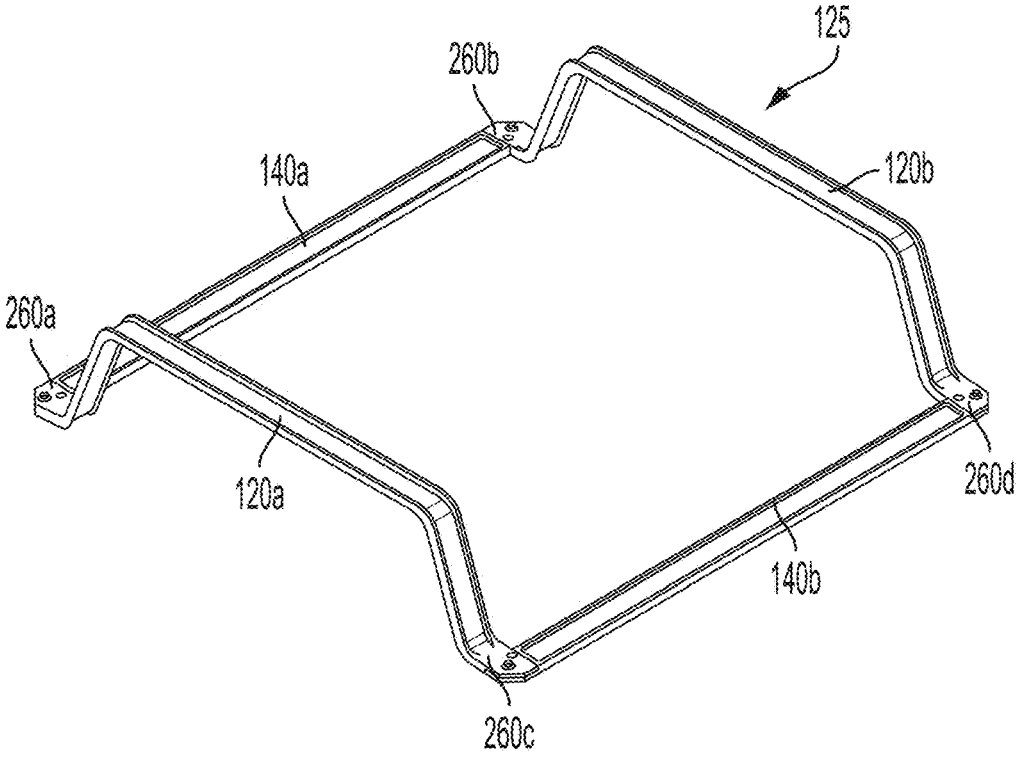
FIG. 2A is a perspective view of an example rung unit.
Figure 2B:
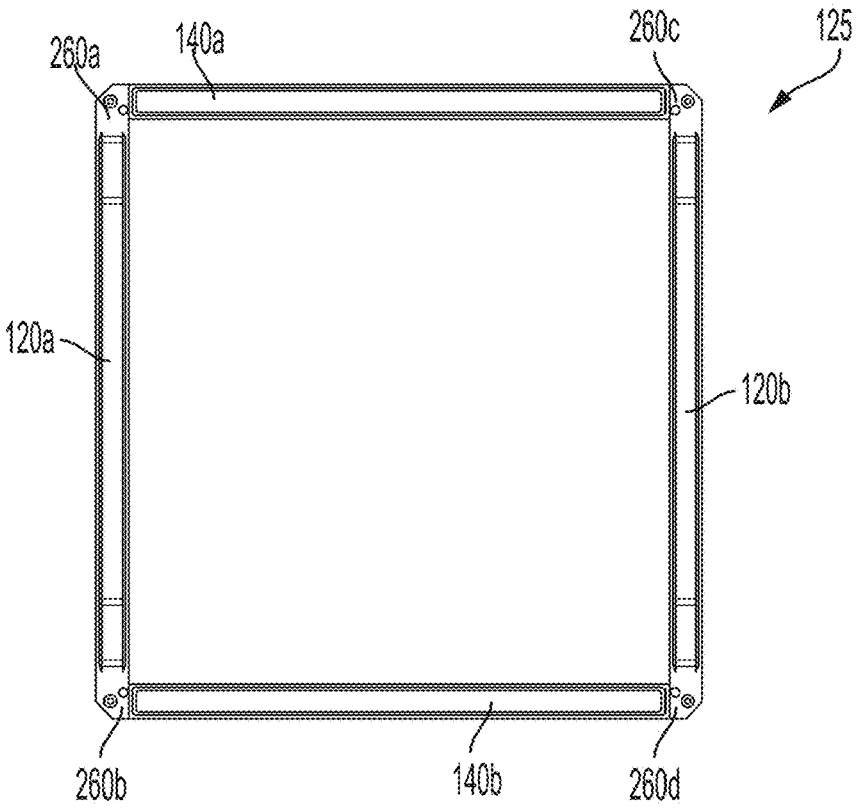
FIG. 2B is a top view of an example rung unit.

Referring to FIGS. 1, 2A and 2B, the present disclosure describes hybrid ladder 100 that is reconfigurable and comprises at least one rung unit 125, each of which has a plurality of elevated rails 120 and a plurality of ground rails 140. (The figures show each rung unit having respective ground rails 140*a* and 140*b*, but this disclosure may generally refer to all such elements as ground rails 140.) Each ground rail 140 is integrated with or connected to at least one elevated rail 120. (The figures show each rung unit having respective elevated rails 125*a* and 125*b*, but this disclosure may generally refer to all such elements as ground rails 140.) The rung units 125 are rotatable such that either the ground rail 140 or the elevated rail 120 are able to function as ladder rungs. As shown in FIG. 1, the ground rail 140*b* of a first rung unit 125*x* may be connected to the ground rail 140*a* of a second rung unit 125*y* via one or more rung unit connectors 175*x*. A rung unit connector (which this document may generally refer to using reference number 175) is an elongated arm with structures at each end that interconnect one rung unit with a next rung unit, as will be described in more detail below. In some embodiments, more than two rung units 125x, 125y, 125z can be separably connected to one another using multiple rung unit connectors 175x, 175y.

FIG. 1 illustrates an example hybrid fitness ladder 100 in a first configuration according to an embodiment, discussed in further detail below. In this configuration, as will be discussed in more detail below, the side rails of the ladder have segments that are elevated with respect to all of the ground rails 140 of the ladder. In this configuration, the hybrid fitness ladder 100 the ground rails 140 of the ladder serve as rungs between partially elevated side rails 125, allowing a user to utilize the hybrid fitness ladder 100 by running, jumping, or otherwise navigating the rungs of the latter without any change in elevation between the side rails.

Figure 3:
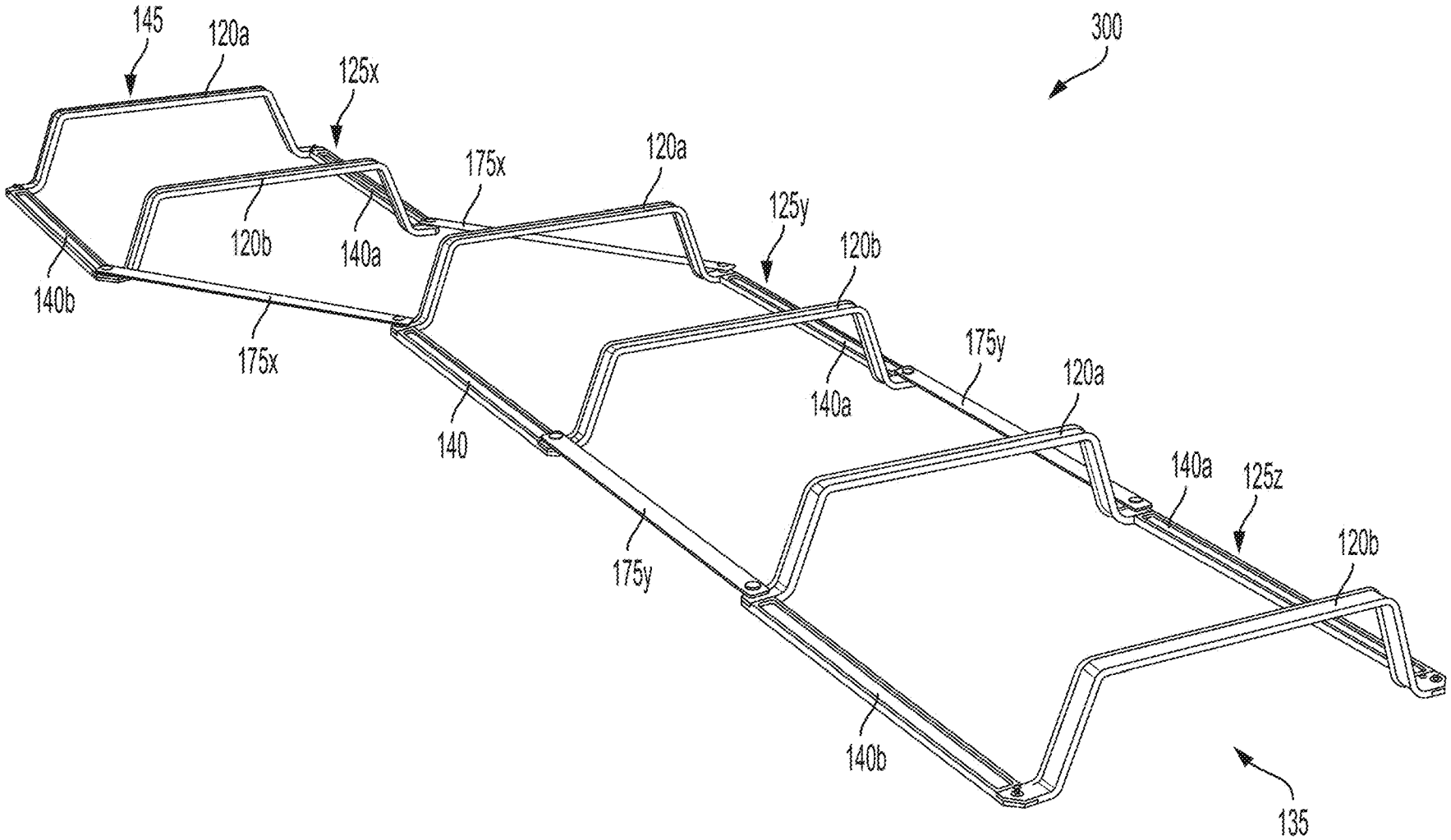
FIG. 3 is a perspective view of an example non-linear hybrid ladder in a second configuration in which the rungs are elevated with respect to the side rails.

FIG. 3 shows another configuration in which the rung units 125 of the hybrid fitness ladder 300 are oriented so that all of the elevated rails 120 are positioned to serve as rungs of the latter, and all of the ground rails 140 of the rung units serve as side rails of the ladder, allowing a user to utilize the hybrid fitness ladder 100 by running between, jumping over, or otherwise navigating the rungs formed of elevated rails 120.

Figure 4:
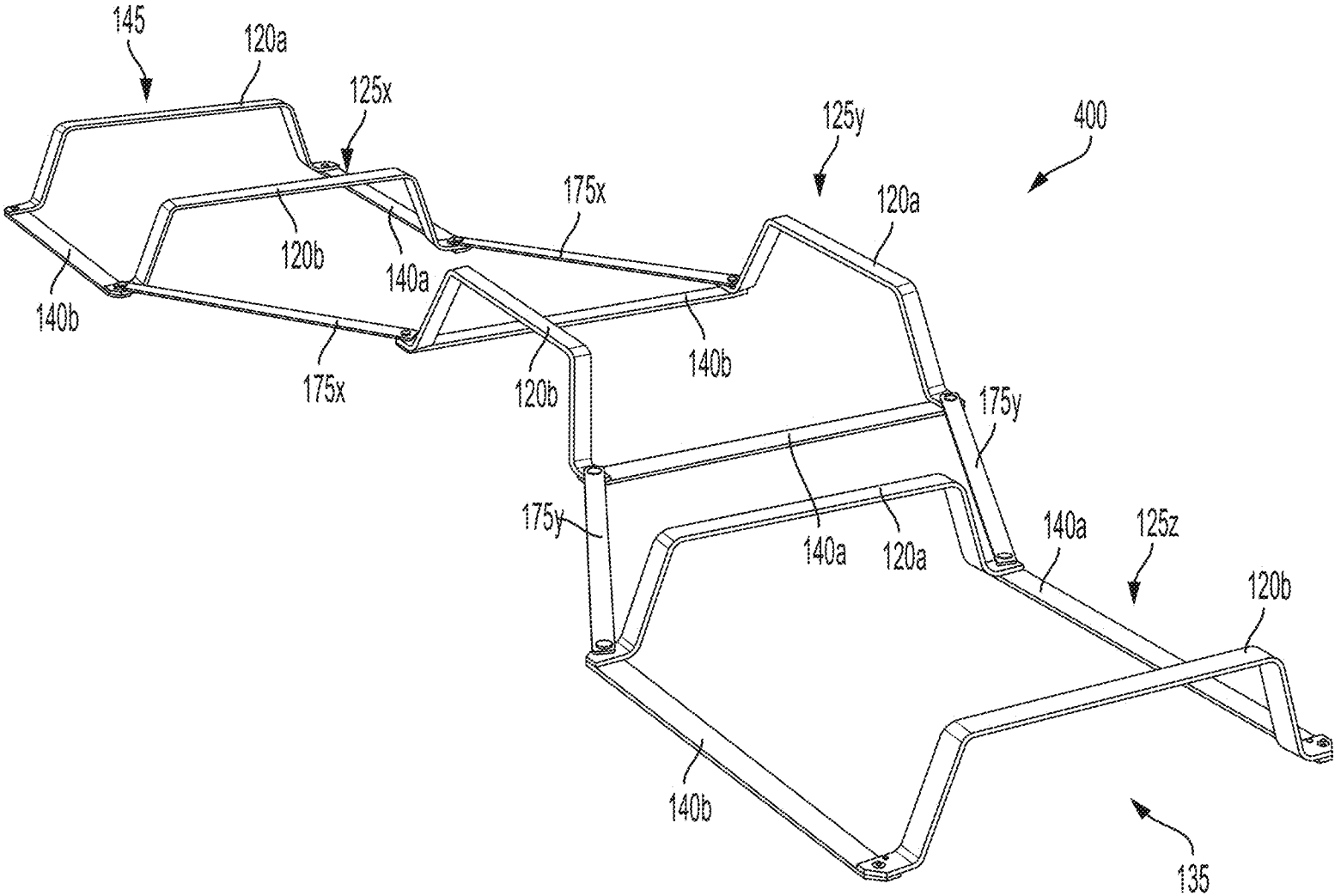
FIG. 4 is a perspective view of another example of a non-linear hybrid ladder in a third configuration.

FIG. 4 shows a third configuration in which ladder 400 incorporates elements of both the first and second configurations. In this configuration, the multiple rung units 125 are interconnected so that for some (but not all) of the rung units (in this case rung units 125x and 125z, the elevated rails 120 are positioned as rungs of the ladder and the ground rails 140 are positioned as side rails of the ladder, while the remainder of the rung units (in this example rung unit 125y is positioned so that the elevated rails 120 are positioned as side rails of the ladder and the ground rails 140 are positioned as rungs of the ladder.

Figure 5:
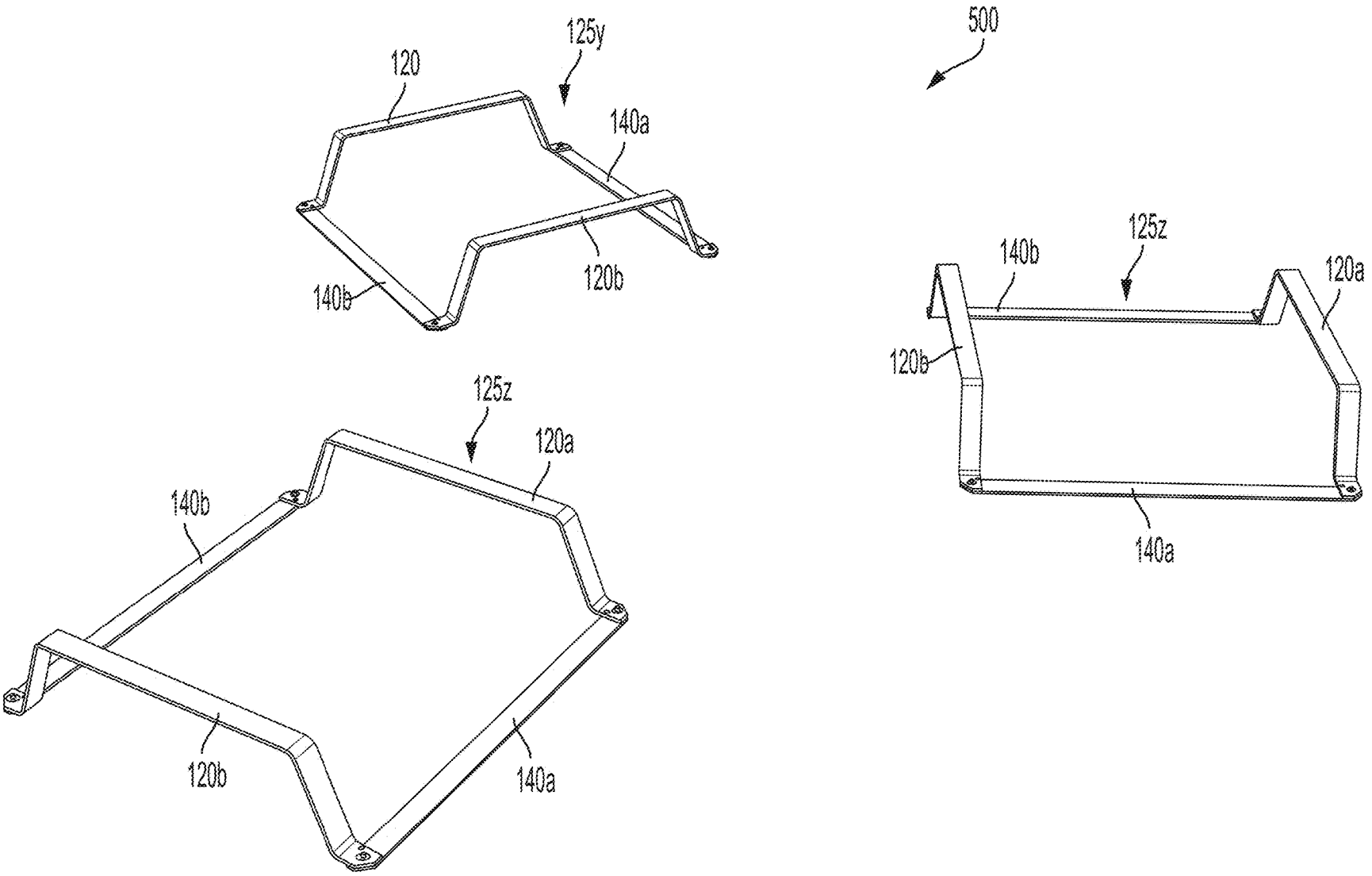
FIG. 5 is a perspective view of an example showing several rung units of a hybrid ladder separated from each other, thus in a fourth configuration.

FIG. 5 shows a fourth configuration in which rung units 125 of ladder 500 are completely separated from each other.

Returning to FIGS. 2A and 2B, features of an example rung unit 125 according to an embodiment will now be described. The rung unit 125 includes at least one elevated rail 120 and at least one ground rail 140. For example, as illustrated in the top view of FIG. 2B, the rung unit 125 includes two substantially parallel elevated rails 120a, 120b that are spaced apart from one another, and two substantially parallel ground rails 140a, 140b that are spaced apart from one another. Thus, each ground rail 140 of the rung unit is perpendicularly positioned with respect to each elevated rail 120. However, embodiments in which the ground rails 140 and elevated rails 120 are positioned at other angles so that they that are not perpendicular to each other are included within the scope of this disclosure. For example, the rung unit 125 may have a rhomboid or parallelogrammatic shape when viewed from above.

The two ground rails 140a, 140b and the two elevated rails 120a, 120b are operably connected to form the rung unit 125. In some embodiments, as shown in FIGS. 2A and 2B, each end of a ground rail 140 may be connected to a corresponding end of an elevated rail 120 of the rung unit at a rung corner 260a-260d (which this disclosure may generally refer to as rung corners 260), thus forming a square or rectangular shape when viewed from above as shown in FIG. 2B. Alternatively, the rung unit 125 may be a single unit of integrated elevated rails 120 and ground rails 140.

Thus, in the examples shown, the rung unit 125 may have first and second elevated rails 120. The first and second elevated rails 120 may be substantially parallel to each other and define a first and second side of the rung unit 125. The rung unit 125 may have first and second ground rails 140 that are substantially parallel to each other and define a third and a fourth side of the rung unit 125. A first end of the first elevated rail 120a may be connected to a first end of the first ground rail 140a at a first corner 260a. A second support member of the first elevated rail 120a may be connected to a first end of the second ground rail 140b at a second corner 260b. A first support member of the second elevated rail 120b may be connected to a second end of the first ground rail 140a at a third corner 260b. A second support member of the second elevated rail 120b may be connected to a second end of the second ground rail 140b at a fourth corner 260d.

In some examples, each ground rail 140 and elevated rail 120 have approximately the same length and/or other dimensions, other than height. In some other embodiments, the ground rails 140 and elevated rails 120 may have different lengths and/or other dimensions.

Figure 6A:
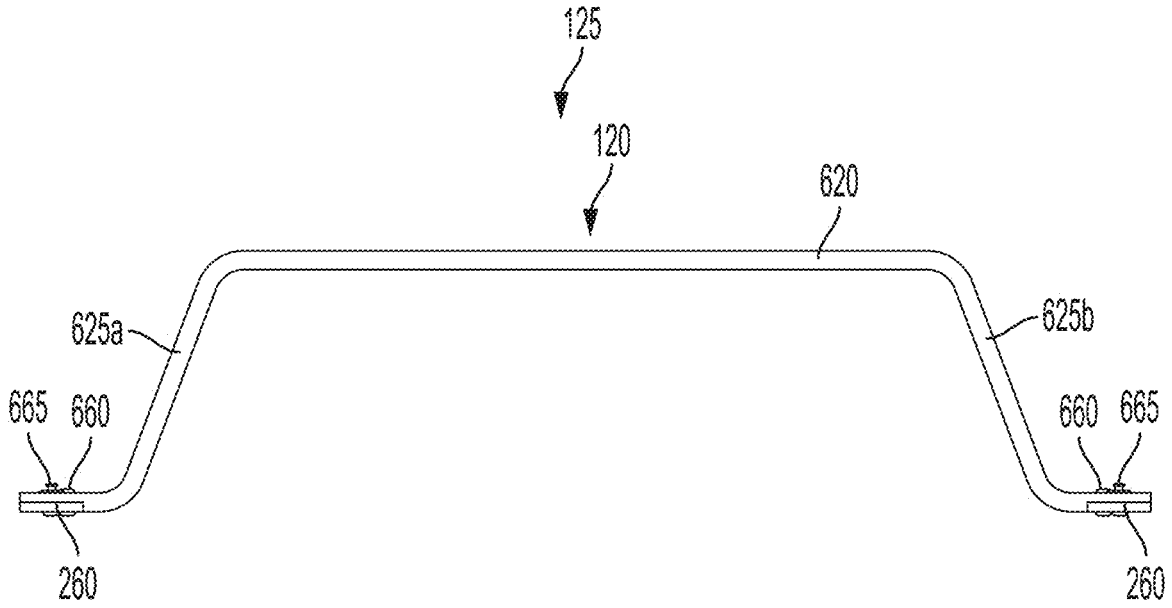
FIG. 6A is a side view of an example rung unit.
Figure 6B:
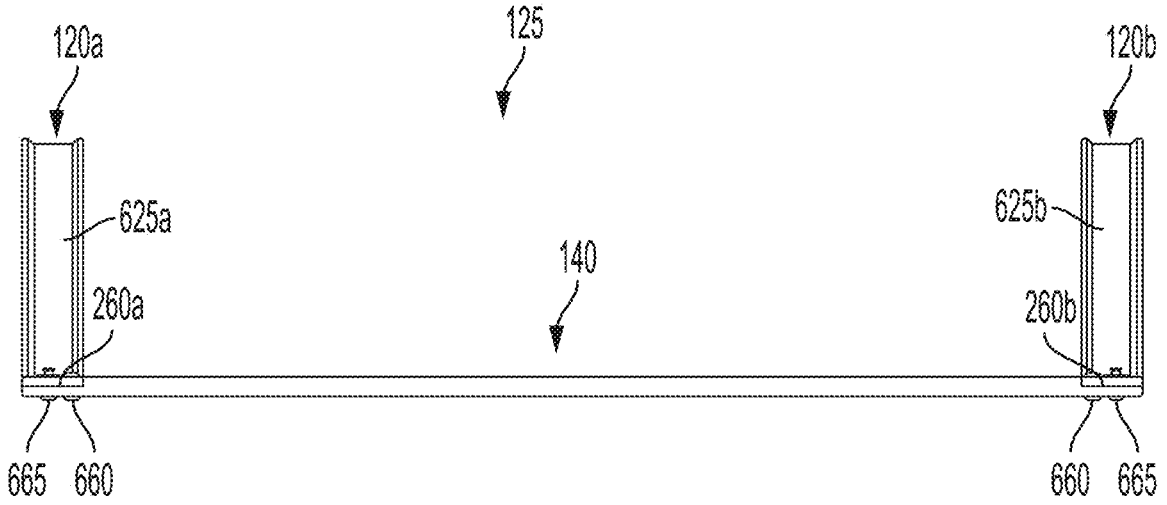
FIG. 6B is a front view of an example rung unit.

FIG. 6A illustrates an example elevated rail 120 of a rung unit 125 according to an embodiment. FIG. 6B is a side view of the rung unit 125 of FIG. 6A. As illustrated in FIGS. 6A and 6B, the rung unit 125 has at least one elevated rail 120. At least a portion of each elevated rail 120 may be positioned at a higher elevation relative to a ground rail 140. For example, each elevated rail 120 may include an elongated portion 620 having a first support member 625a and a second support member 625b. The elongated portion 620 may extend between the first support member 625a and the second support member 625a. The elongated portion 620 may be supported in an elevated position by the first support member 625a and the second support member 625b. The first support member 625a may be integrally connected to a first end of the elongated portion 620. The second support member 625b may be integrally connected to a second end of the elongated portion 620. Each support member 625a, 625b may be configured at angle relative to a surface on which the rung unit 125 is positioned. Support members 625a, 625b each may be connected at a second end to an end of a ground rail 140. For example, in FIG. 6A, the ends of the support members 625a, 625b may be generally rounded to create a gradual transition from the elevated, elongated portion 620 of the elevated rail 120 to the ground rung 140. Alternatively, the connections between the elongated portion 620 and the support members 625a, 625b, as well as the connections between the support members 625a, 625b and the rung corner 260 may be more rigid, creating sharp angles. As another alternative, the elevated rail 120 may be semi-circular in shape between two rung corners 260.

The height of the elongated portion 620 with respect to a rung corner 260, ground rung 140, or surface on which the rung unit 125 is positioned may be any height appropriate for various training exercises. For example, the elongated portion 620 may have a height of at least 0.5 inch, at least 1 inch, less than 10 inches, less than 8 inches, about 1 inch to 8 inches, 1 inch to 2 inches, 2 inches to 3 inches, 3 inches to 4 inches, or 4 inches to 5 inches, 5 inches to 6 inches, 6 inches to 7 inches, or 7 inches to 8 inches with respect to any of the above-described elements.

The angle of one or more of the support members 625a, 625b with respect to a ground rung 140, elongated portion 620, or ground surface may be any angle to achieve the desired height of the elongated portion 620. For example, support members 625a, 625b may each be angled at about 30 to about 90 degrees, about 30 to about 40 degrees, about 40 to about 50 degrees, about 50 to about 60 degrees, about 60 to about 70 degrees, about 70 to about 80 degrees, or about 80 to about 90 degrees with respect to any of the above-described elements. Additional and/or alternate angles may be used within the scope of this disclosure.

Each elevated rail 120 may be of any shape, size, dimensions, composition, texture, and/or other characteristics that are appropriate for the proper function of the elevated rails. For example, each elevated rail 120 may have a thickness of at least 0.1 inch, less than 0.5 inch, about 0.1 to 0.5 inch, about 0.1 to 0.2 inch, about 0.2 to about 0.3 inch, about 0.3 to about 0.4 inch, or about 0.4 to about 0.5 inch. In some embodiments, each elevated rail 120 has an I-beam construction and is thicker at the edges of the rail than in the center, as illustrated in, for example FIGS. 6B and 8. In some embodiments, the edges of the elevated rail 120 may have a thickness of at least 0.1 inch, less than 0.5 inch, about 0.1 to about 0.5 inch, about 0.1 to about 0.2 inch, about 0.2 to about 0.3 inch, about 0.3 to about 0.4 inch, or about 0.4 to about 0.5 inch. For example, the center of each elevated rail may have a thickness of approximately 0.1 inch at the center and a thickness of approximately 0.3 inch at the edges. An elevated rail 120 may have a width of at least 0.5 inch, less than 3 inches, about 0.5 to about 3 inches, about 0.5 to about 1 inch, about 1 to about 1.5 inch, about 1.5 to about 2 inches, about 2 to about 2.5 inches, or about 2.5 to about 3 inches. It is understood that elevated rails 120 having alternate thicknesses and/or widths are within the scope of this disclosure.

In this document, the "length" of an elevated rail 120 is its dimension as measured from one end to another (i.e., from one rung corner 260 of a rung unit 125 to another rung corner of the rung unit), while "width" of an elevated rail 120 is the dimension that is parallel to length when viewed from above. Each elevated rail 120 may have a length appropriate for the purpose of the hybrid fitness ladder 100. For example, each elevated rail 120 may have a length (as measured from one end of the elevated rail to the other) that is approximately the "hip width" or "shoulder width" of an average person. Elevated rails may be at least 15 inches, less than 25 inches, about 15 to about 19 inches, about 15 to about 16 inches, about 16 to about 17 inches, about 17 to about 18 inches, or about 18 to about 19 inches. It is understood that elevated rails 120 having alternate lengths are within the scope of this disclosure.

Each ground rail 140 may have an elongated portion that extends between a first end and a second end of the first ground rail 140. In some embodiments, at least a portion of the elongated portion of each ground rail 140 is configured to contact a surface on which the hybrid fitness ladder is positioned. In some examples, each ground rail 140 has substantially the same dimensions and features as each elevated rail 120. For example, each ground rail 140 may have substantially the same thickness and width as each elevated rail 120. In other embodiments, each ground rail 140 may have different dimensions than the elevated rails 120.

Each ground rail 140 may be of any shape, size, dimensions, composition, texture, and/or other characteristics that are appropriate for the proper function of each ground rail. For example, a ground rail 140 may have a uniform thickness of at least 0.1 inch, less than 1 inch, about 0.1 to about 0.5 inch, about 0.1 to about 0.2 inch, about 0.2 to about 0.3 inch, about 0.3 to about 0.4 inch, or about 0.4 to about 0.5 inch. In other embodiments, a ground rail 140 may be thicker at its edges than in its center, as illustrated in, for example FIG. 8. In some examples, the ground rail 140 may have an I-beam shaped cross-section. The edges of the ground rail 140 may have a thickness of at least 0.1 inch, less than 1 inch, about 0.1 to about 0.5 inch, about 0.1 to about 0.2 inch, about 0.2 to about 0.3 inch, about 0.3 to about 0.4 inch, or about 0.4 to about 0.5 inch. For example, the center of the ground rail may have a thickness of about 0.1 inch at the center and a thickness of about 0.3 inch at the edges. Each ground rail 140 may have a width of greater than 0.5 inch, less than about 3 inches, about 0.5 to about 3 inches, about 0.5 to about 1 inch, about 1 to about 1.5 inch, about 1.5 to about 2 inches, about 2 to about 2.5 inches, or about 2.5 to about 3 inches. It is understood that ground rails 140 having alternate thicknesses and/or widths are within the scope of this disclosure.

Ground rails 140 may additionally have any length appropriate for the purposes of the hybrid fitness ladder 100. For example, ground rails 140 may have a length (as measured from one end of the elevated rail to the other) that is approximately the "hip width" or "shoulder width" of an average person. Ground rails 140 may be at least 15 inches, less than 20 inches, about 15 to 19 inches, about 15 to about 16 inches, about 16 to about 17 inches, about 17 to about 18 inches, or about 18 to about 19 inches. It is understood that ground rails 140 having alternate lengths are within the scope of this disclosure. Optionally, ground rails 140 may have the same length as elevated rails 120. For example, ground rails 140 and elevated rails 120 may each be about 18 inches long and about 1 inch wide. The ground rails 140 and elevated rails 120 may be connected in a square such that the outside of the square is about 18 inches by about 18 inches and the interior of the square is about 16 inches by about 16 inches. Alternatively, the ground rails 120 may each have a different length than the elevated rails 120 in the rung unit 125.

An elevated rail 120 and/or ground rail 140 may have one or more additional features that provide for enhanced grip or traction. For example, grip tape, adhesives, or textured markings may be applied to at least a portion of an elevated rail 120 and/or a ground rail 140. The elevated rails 120 and ground rails 140 illustrated in FIGS. 1-11 are shown as having substantially linear elements. However, it is contemplated that an elevated rails 120 and/or ground rails 140 may have non-linear curves or angles within the scope of this disclosure.

In some embodiments, such as that shown in FIGS. 6A and 6B, a ground rail 140 may attach at a first end to a first elevated rail 120*a* and at a second end to a second elevated rail 120*b*. The ground rail 140 may attach to each elevated rail 120*a*, 120*b* at a corresponding rung corner 260*a*, 260*b*. In various embodiments, each ground rail 140 and elevated rail 120 may be immovably connected at a rung corner 260. Alternatively, a ground rail 140 and an elevated rail 120 may be pivotally connected to one another at a rung corner 260. In other embodiments, an elevated rail 120 and a ground rail 140 may be integrally joined at a rung corner 260. In other embodiments, an elevated rails 120 and a ground rail 140 may connect at a rung corner 260 via a lap joint where the ends of each run overlap and are fastened together.

In some embodiments, the elevated rails and ground rails 140 are permanently connected at the rung corners 260. In other embodiments, the elevated rails 120 and ground rails 140 of a rung unit 125 are separable from one another. For example, the elevated rail 120 and the ground rail 140 of a rung unit 125 may be secured in such a way that a user may separate them with or without using ordinary tools. For example, as shown in FIG. 6B, the ends of an elevated rail 120 and the ends of a ground rail 140 are configured to overlap at a rung corner 260 and be secured with a rung joint 660. The rung joint 660 may be any suitable mechanism for attaching two objects. Examples of rung joints 660 may include, without limitation, a snap, a stud, a screw, a nut and bolt, a button, a magnet, hook and loop fastener, split pin fastener, and/or the like. The rung joint 660 may be configured to permanently join the elevated rail 120 with the ground rail 140, or the rung joint 660 may allow for the elevated rail 120 to be selectively coupled and decoupled to the ground rail 140.

Figure 8:
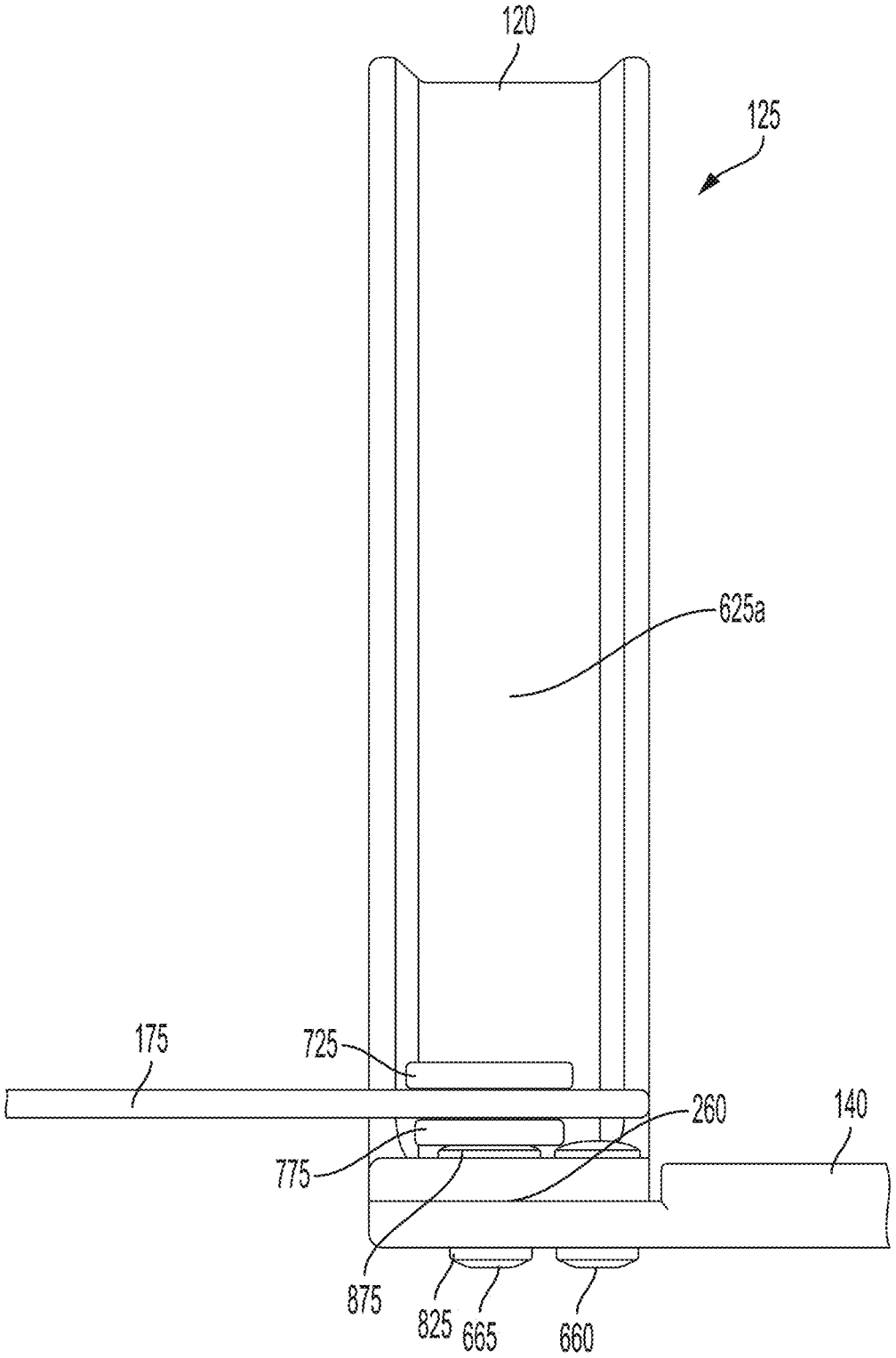
FIG. 8 is a front view of an example rung unit and an example rung unit connector.

As shown in FIGS. 6B and 8, each rung corner 260 also may have a first connector joint element 665 configured to allow the rung corner to engage with a second rung unit connector element of a rung unit connector 175. Optionally, the first connector joint element 665 may additionally function to secure the elevated rail 120 with the ground rail 140. In other contemplated embodiments, the rung joint 660 and the first connector joint element 665 may be a single unit. It is contemplated that one of ordinary skill may use alternative ways to join the elevated rail 120 and the ground rail 140.

Figure 7A:
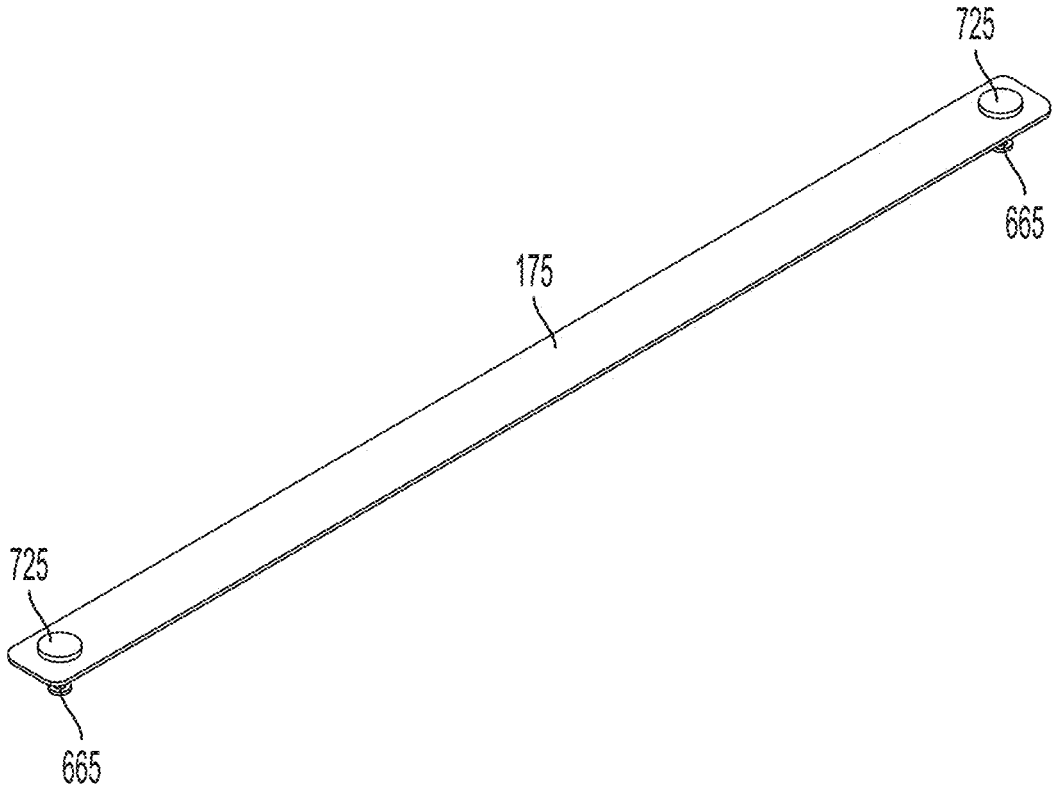
FIG. 7A is a perspective view of an example rung unit connector.
Figure 7B:
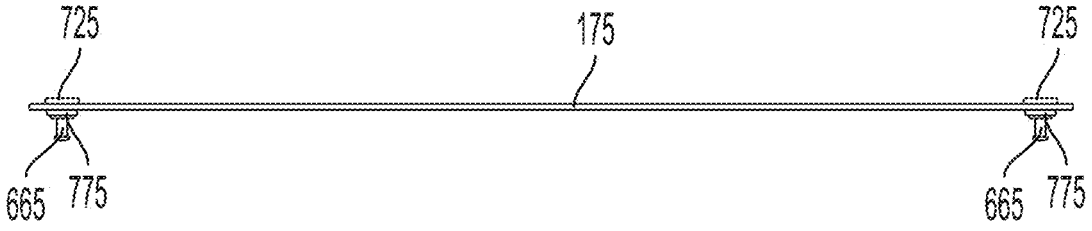
FIG. 7B is a side view of an example rung unit connector.

As shown in FIGS. 7A and 7B, the rung unit connector 175 may be made of a flexible fabric, such as nylon. The rung unit connector 175 may also be rigid and made of a polymer, metal, wood or another material. In embodiments where the rung unit connector 175 is rigid, the rung unit connector 175 may be substantially straight or non-linear. In some embodiments, the rung unit connector 175 may be less than 0.1 inch. Alternatively, the rung unit connector 175 may be greater than 0.1 inch, less than 1 inch, about 0.1 inch to 1 inch, about 0.1 to about 0.3 inch, about 0.3 to about 0.5 inch, about 0.5 to about 0.7 inch, about 0.7 to about 1 inch in thickness. Rung unit connectors 175 may have a width of greater than 0.5 inch, less than 2 inches, about 0.5 to about 2 inches, about 0.5 to about 1 inch, about 1 to about 1.5 inch, or about 1.5 to about 2 inches. Rung unit connectors 175 may be greater than 15 inches, less than 19 inches, about 15 to about 19 inches, about 15 to about 16 inches, about 16 to about 17 inches, about 17 to 18 inches, about 18 to about 19 inches.

On either end of the rung unit connector 175, there may be a way of separably connecting the rung unit connector 175 to a rung corner 260. For example, the rung unit connector 175 may have a second connector joint element 765, as best shown in FIG. 7B, in which the first connector joint element 665 includes a post and the second connector joint element 765 includes a receptacle that receives the post. The relative positions of posts and receptacles may be reversed in other embodiments.

The rung unit connector 175 may further have a connector cap 725 (see FIGS. 7A and 7B) which may serve various functions including securing the second connector joint element 765 to the first connector joint element 665 and/or rung corner 260; protecting the connector joint elements 665, 765 and/or rung corner 260 from damage; protecting the user from contacting the connector joint elements 665, 775 and/or rung corner 260; or allowing for removability of the rung unit connector 175 from the rung corner 260. The rung unit connector 175 may also have a separator 775 positioned between the rung unit connector 175 and the rung corner 260. The separator 775 may be a washer or a bearing and may provide spacing between the rung unit connector 175 and the rung corner 260 and to promoting rotatability of the rung unit connector 175 with respect to a rung unit 125.

The rung unit connector 175 may engage with the rung corner 260 of a rung unit 125 in any suitable way. In certain embodiments, the rung unit connector 175 is selectively removable from the rung unit 125 to allow for disassembly and storage.

Additionally, the rung unit connector 175 is selectively removable from the rung units 125 to allow for alternative configurations such as the configurations shown in FIGS. 1 and 3-5. Other configurations including more or less than the three rung units 125 and four rung unit connectors 175 are additionally possible. For example, more or less rung units 125 and rung unit connectors 125 can be used for different configurations depending on a desired use. In some examples, a hybrid configuration can exist where one or more rung units 125 that are separated can be used with one or more rung units 125 that are connected by one or more rung unit connectors 175. Additionally, rung units 125 can be rotated such that the ground rails 140 and the elevated rails 120 are switched with respect to the configurations of FIGS. 1, and 3-5. Additionally, a combination of rung units 125 with elevated rails 120 being parallel and perpendicular to one another is possible such that some rung units 125 are rotated and some are in a similar configuration with respect to the configurations of FIGS. 1, and 3-5 and other configurations described herein.

As shown in FIG. 8, the end of the rung unit connector 175 may be configured to align vertically with an end of an elevated rail 120 and an end of a ground rail 140. In some embodiments, an end of a rung unit connector 175, an end of an elevated rail 120 and an end of a ground rail 140 may each have an aperture, which may be aligned such that a first connector joint element 665 may pass through a corresponding second connector joint element 775 of a rung unit connector 175, an elevated rail 120, and a ground rail 140, thereby holding the members together at the rung corner 260. Optionally, first connector joint elements 665 may each include a post to which an upper rivet 875 and a lower rivet 825 are attached, positioned above and below both an end of an elevated rail 120 and an end of a ground rail 140. The upper rivet 875 and lower rivet 825 may be configured to stabilize the connection of an elevated rail 120 and a ground rail 140. A separator 775 and a connector cap 725 may be positioned above and below the rung unit connector 175 and engaged with a first connector joint elements 665. Separators 775 and connector caps 725 may be configured to allow the user to easily disengage rung unit connectors 175 from rung units 125. The connection in FIG. 8 is one example of a contemplated way of joining a rung unit connector 175, with a ground rail 140, and an elevated rail 120. Additionally, alternative connections that allow for easy disengagement and separation of rung unit connectors 175 from rung units 125 known or discernable to one of ordinary skill are contemplated.

Figure 9A:
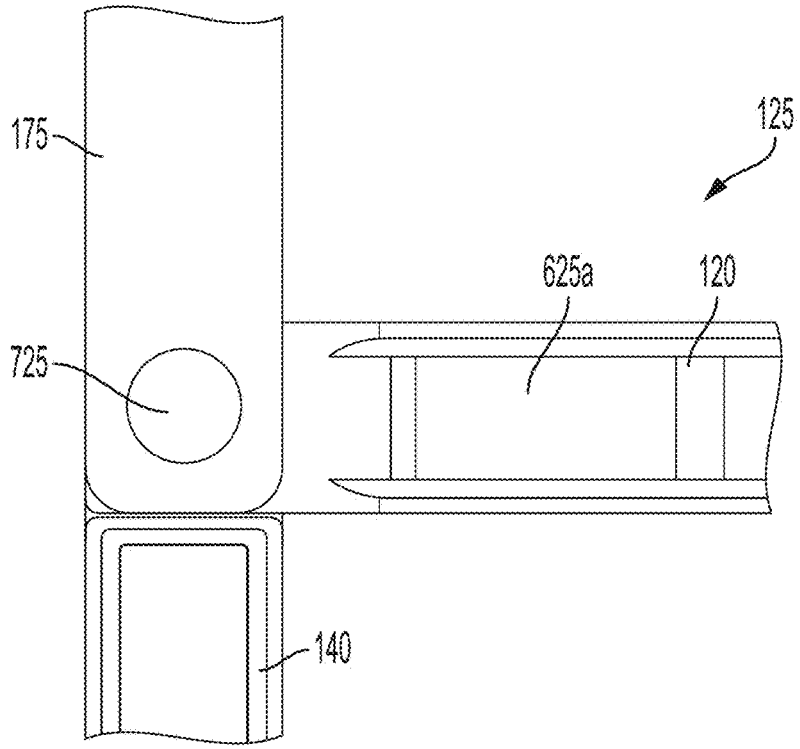
FIG. 9A is a top view of an example rung unit and an example rung unit connector with the rung unit connector in a ground-aligned position.
Figure 9B:
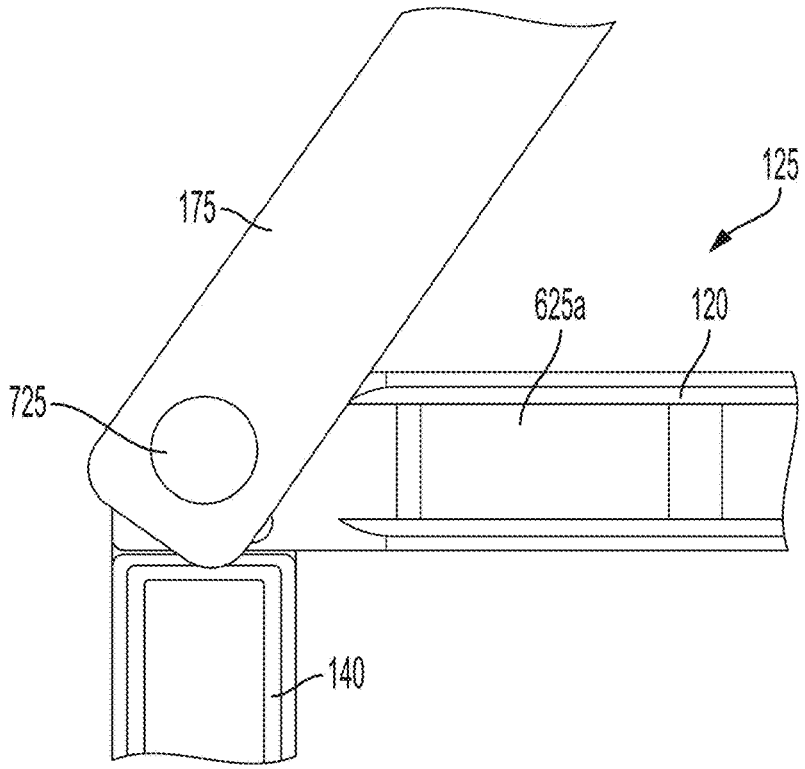
FIG. 9B is a top view of an example rung unit and an example rung unit connector with the rung unit connector in an unaligned position.

As shown in FIGS. 9A and 9B, a rung unit connector 175 may be configured to rotate or be removed to switch positions with respect to a rung unit 125. As shown in FIG. 9A, the rung unit connector 175 may be configured to have a ground-aligned position, where one or more rung unit connectors 175 are substantially parallel to a ground rail 140 and substantially perpendicular to an elevated rail 120. The rung unit connector 175 may be configured to have an elevated-aligned position where one or more rung unit connectors 175 are substantially parallel to an elevated rail 120 and substantially perpendicular to a ground rail 140 (such as is illustrated in FIG. 1). As shown in FIG. 9B, rung unit connectors 175 may also be configured to have an unaligned position, where the rung unit connector 175 is neither substantially parallel to an elevated rail 120 nor substantially parallel to a ground rail 140. This is shown by way of example by rung unit connectors 175*x* in FIG. 3, and all rung unit connectors 175*x*, 175*y* of FIG. 4. The rung unit connector 175 may be configured to rotate freely around the connector joint 665.

The rung unit connector 175 may have at least one reciprocal fastener element. The reciprocal fastener element may removably and rotatably attach to a fastener element on a rung unit 125. A rung unit 125 may have a plurality of fastener elements. A fastener element may connect to a reciprocal fastener element using any suitable element. Examples of fastener elements and reciprocal fastener elements may include, without limitation, a snap, a button, a magnet, hook and loop fastener, split pin fastener, and/or the like. The fastener elements and reciprocal fastener elements may also be configured allow the rung unit connector 175 to rotatably "snap" into the ground-aligned or elevated-aligned position, such that a user can maintain a more linear hybrid ladder (for example in FIG. 1). The fastener elements and reciprocal fastener elements may "snap" into place using any suitable mechanism.

The hybrid fitness ladder 100 may be made of any suitable materials or combinations of materials. Elevated rails 120 and ground rails 140 may be made of a rigid material. Alternatively, elevated rails 120, ground rails 140, or both may be made of a semi-flexible material that allows the hybrid fitness ladder 100 to bend without breaking. Elevated rails 120 and ground rails 140 may be made of a semi-flexible material that is biased toward a first configuration such that when elevated rails 120 and ground rails 140 are deformed, they will return to the first configuration. For example, in such embodiments, when a user steps on an elevated rail 120, the elevated rail 120 will be deformed and will return to its original configuration when the user steps off the elevated rail 120. For example, elevated rail 120 and ground rail 140 may be made of an injection molded plastic. Elevated rails 120 and ground rails 140 may be made of a polyethylene plastic. An elevated rail 120 and/or a ground rail 140 may have other structures, textures, and/or shapes that provide strength, stability, and/or flexibility. In some embodiments, the fasteners of the hybrid fitness ladder 100 may be made of a metal. In some embodiments, rung unit connectors 175 may be made of a flexible material such as nylon.

In some configurations, a first rung unit 125 may be connected to a second rung unit 125 by one or more rung unit connectors 175. In other configurations, a first rung unit 125 is connected to a second rung unit 125 by two rung unit connectors 175. One example configuration is shown in FIG. 1, a first rung unit 125*x* may be connected to a second rung unit 125*y* by two rung unit connectors 175*x*; and the second rung unit 125*y* may be further connected to a third rung unit 125*x* by two rung unit connectors 175*y*. More or fewer rung units 125 may be attached or removed from the hybrid ladder 100 in this fashion.

In the configuration depicted in FIG. 1, each rung unit connector 175 may have a first end 173 and a second end 177. As shown in various other figures, when attached to a rung unit 125, a rung unit connector 175 may be configured to pivotally engage with a rung corner 260. Multiple rung unit connectors 175 may attach to a single rung unit 125, and a single rung unit connector 175 may attach to multiple rung units 125. For example, a first end 173 of a rung unit connector 175 may attach to a rung corner 260 of one rung unit 125, while the second end 177 of the rung unit connector 175 may attach to a rung corner 260 of a different rung unit 125. As illustrated in FIG. 1, a rung unit connector 125 may have a linear shape. However, it is understood that other shapes of rung unit connectors 125 may be used within the scope of this disclosure. In particular, the rung unit connectors 125 may be made of a flexible material that may be linear or non-linear depending on the intended configuration of the hybrid ladder 100.

In the configuration depicted in FIG. 1, two rung unit connectors (each designated as 175*x*) may form a rung unit connector pair in which each rung unit connector 175*x* attaches to two rung units 125*x* and 125*y*. A first end 173 of a first rung unit connector 175*a* may connect to one rung unit 125*a*, while the second end 177 of the first rung unit connector 175*a* may connect to the other rung unit 125*b*. Similarly, a first end 173 of a second rung unit connector 175*b* may connect to rung unit 125*a*, while the second end 177 of the second rung unit connector 175*b* may connect to the other rung unit 125*b*.

Figure 10A:
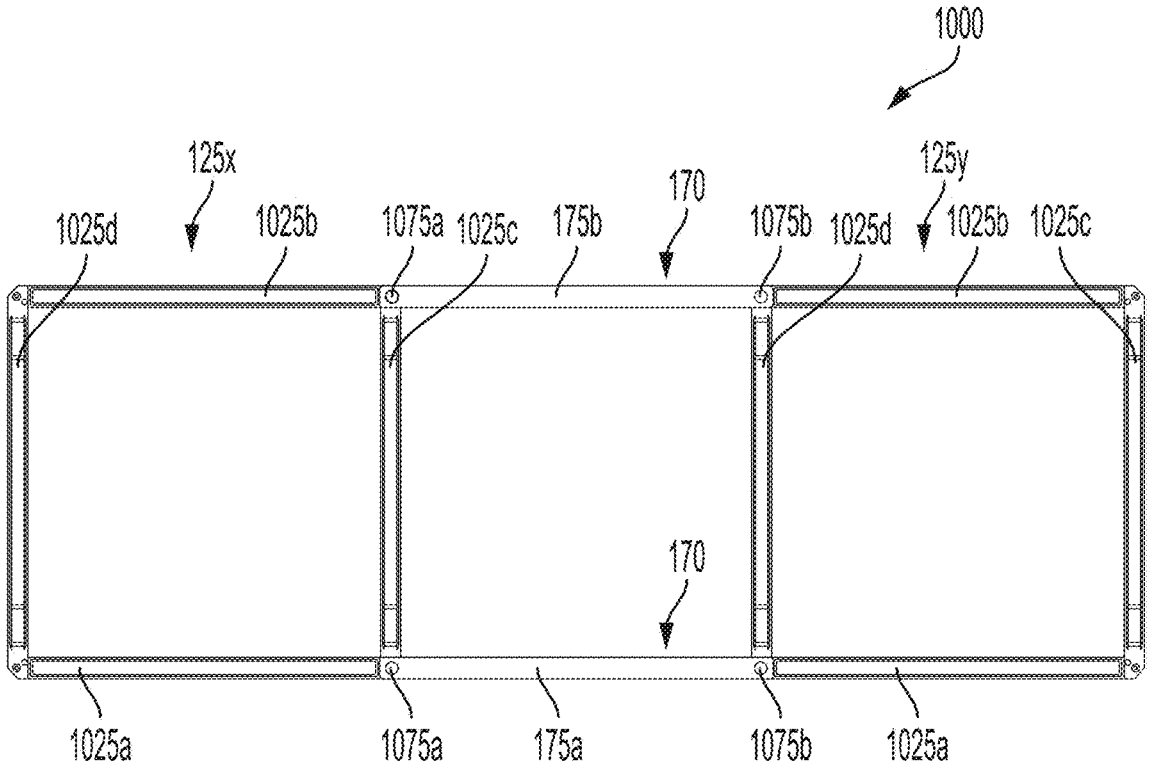
FIG. 10A is a top view of two example rung units connected by two example rung unit connectors.
Figure 10B:
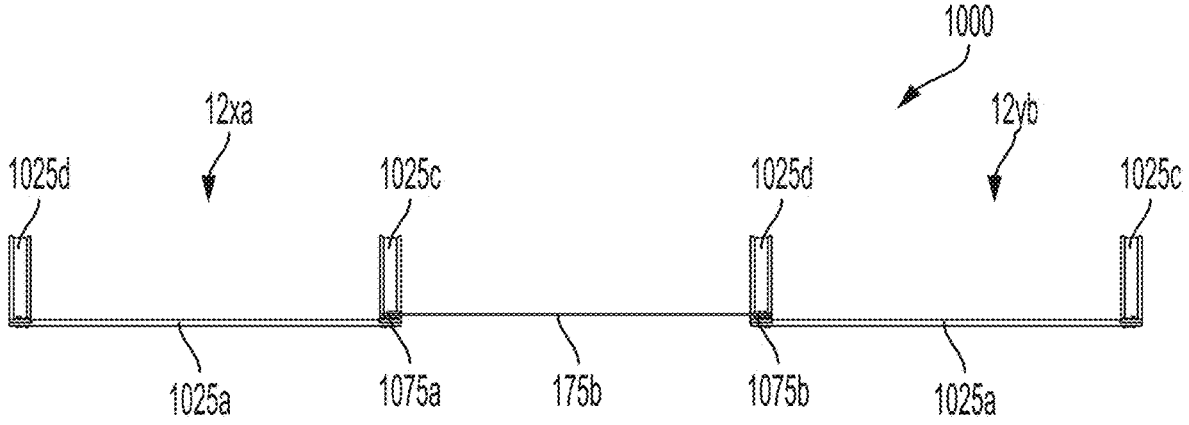
FIG. 10B is a front view of two example rung units connected by two example rung unit connectors.

As described previously, the rung unit connector 175 may be used to connect a plurality of rung units 125 together to form a hybrid ladder, such as the hybrid ladder 100 of FIG. 1. Another example, as shown of a configuration of the hybrid ladder 1000 is depicted in FIGS. 10A and 10B, a first rung unit 125*x* can be connected to a second rung unit 125*x* by a rung unit connector pair comprising a first rung unit connector 175*a* and a second rung unit connector 175*b*. For example, a first rung unit connector 175*a* may have a first rung unit connector end 1075*a* which connects to a first rung unit 125*x* at the corner of sides 1025*a* and 1025*c*, and a second rung unit connector end 1075*b*, which connects to a second rung unit 125*y* at a corner of sides 1025*a* and 1025*d*. Additionally, a second rung unit connector 175*b* may have a first rung unit connector end 1075*a*, which connects to a first rung unit 125*x* at a corner of sides 1025*b* and 1025*c*, and a second rung unit connector end 1075*b*, which connects to a second rung unit 125*y* at a corner of sides 1025*b* and 1025*d*. Additional rung unit connectors 175 and rung units 125 may be added to the hybrid ladder 1000 of FIGS. 10A and 10B by, for example, attaching a rung unit connector pair 170 to a side 1025*a* and/or side 1025*b* of the second rung unit 125*y* to provide an L-shaped configuration or a T-shaped configuration. A plurality of rung units 125 may be aligned in this fashion to produce a hybrid ladder 100 of any length, and a variety of shapes. The hybrid ladder 1000 of FIGS. 10A and 10B illustrates example embodiments of the ladder where the elevated rails 120 are substantially parallel to a first end 135 and a second end 145 of the ladder. Alternatively, at least one of the rung units 125 may be rotated about 90 degrees, such that at least one ground rail 140 is parallel with a first end 135 and a second end 145 of the ladder. In other embodiments, two rung units 125 may be connected by a single rung unit connector 175 to allow the ladder to form different shapes, such as squares or circles.

The hybrid fitness ladder 100 may be formed from any number of repeating rung units 125 and rung unit connector pairs 170. The configuration described above is an example, and alternative configurations may be used within the scope of this disclosure.

In certain embodiments, a hybrid ladder 100 may have two side rails, which represent the combination of rungs units and rung unit connectors that align the long edge of the hybrid ladder 100. For example, in FIG. 1, the hybrid ladder 100, has two side rails. A first side rail includes one of each rung unit connector 175*x* and 175*y* and an elevated rail 120*a* of each rung unit. A second side rail includes one of each rung unit connector 175*x* and 175*y* and the other elevated rails 120*b*, of each rung unit.

In various embodiments, rung units 125 may be connected in series by one or more rung unit connectors 175 such that the side rails include all of the available elevated rails 120, as illustrated in FIG. 1. In other embodiments, as illustrated in, for example, FIG. 3, all side rails of the ladder 300 may be ground rails 145. In other "mixed" embodiments, as illustrated by FIG. 4, for example, side rails of the ladder 400 may be made of both elevated rails 120 and ground rails 140.

In another configuration, as illustrated by, for example, FIG. 5, a separated hybrid ladder 500 is shown. The separated hybrid ladder 500 includes one or more rung units 125 that are not connected to one or more other rung units 125 by rung unit connectors 175, such that one or more rung units 125 may be positioned in any unconnected orientation with respect to one or more other rung units 125. FIGS. 1-5 illustrate examples of ways that a user can arrange the hybrid ladder, but any other hybrid ladder arrangement is within the scope of this disclosure.

In various configurations, such as the hybrid ladder 100 illustrated in FIG. 1, rung units 125 may be connected by rung unit connectors 175 such that the rung units 125 and the rung unit connectors 175 are arranged in a substantially linear configuration. In other embodiments, one or more rung unit connectors 175 may pivot with respect to one or more rung units 125, such that they are arranged in a substantially nonlinear configuration. One or more rung unit connectors 175 may be pivoted with respect to one or more rung units 125 at one or more locations along the hybrid fitness ladder, for example a non-linear configuration of a hybrid ladder 400 is depicted in FIG. 4.

The above examples do not limit the possible configurations of the hybrid ladder described in this disclosure. For example, it is understood that a hybrid fitness ladder may be of any length and may have any number of pivots along the length of the ladder within the scope of this disclosure.

Figure 11:
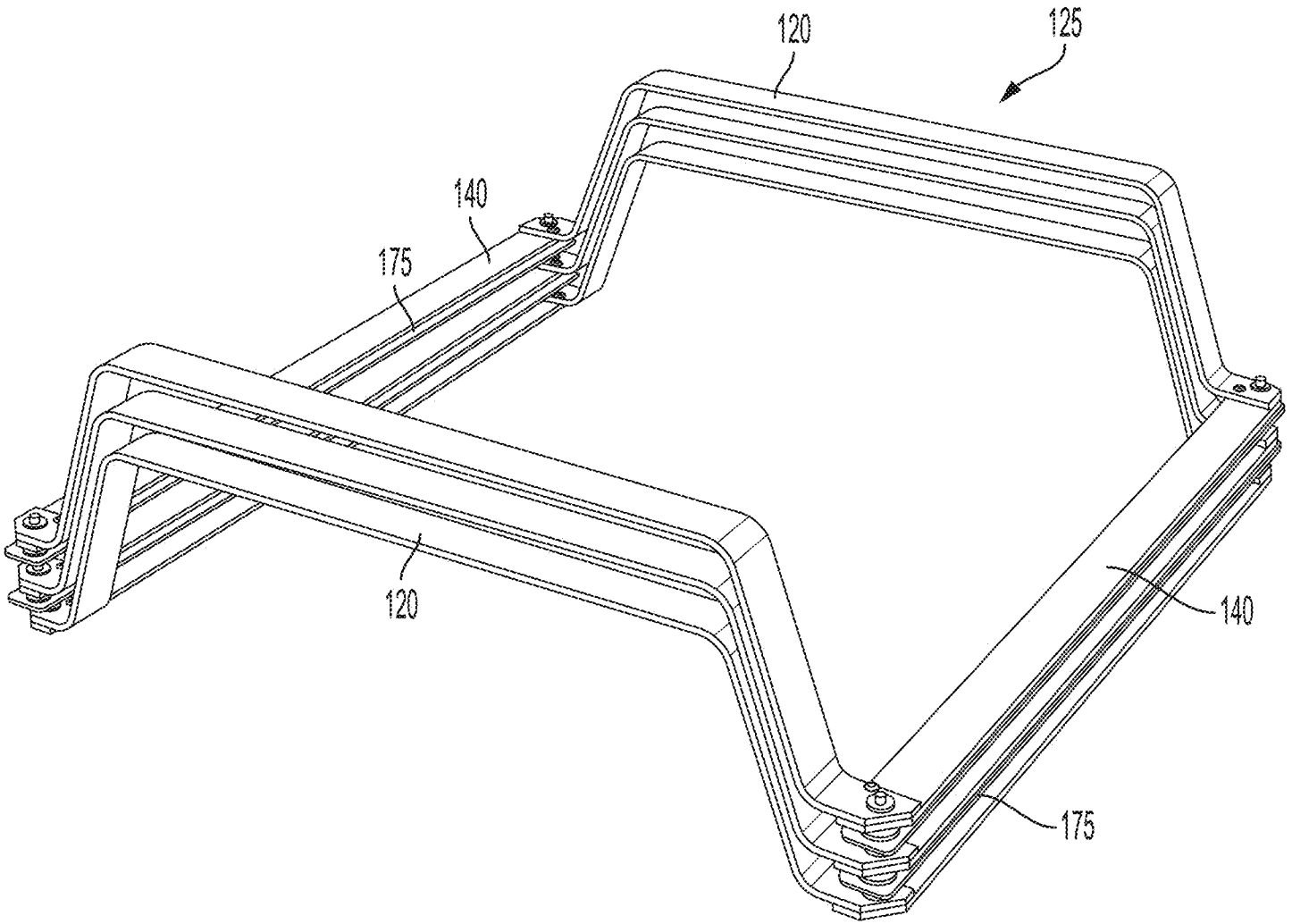
FIG. 11 is a perspective view of three example rung units in a stacked configuration.

As shown in FIG. 11, the hybrid ladder 100 of the present disclosure may be configured to partially disassemble and stack for ease of storage. Rung units 125 may be configured to have substantially the same dimensions, to allow one rung unit 125 to stack on a second rung unit 125. Each of the rung unit connectors 175 may be disconnected from a rung unit 125 at one end of the rung unit connector 175, such that the rung unit connector 175 may rotate such that the rung unit connector 175 is parallel with a ground rail 140 of the rung unit 125. This configuration allows for rung units 125 and rung unit connectors 175 to stack together for storage. The hybrid ladder of the present disclosure may be stored in combination with other storage devices known in the art. For example, rung units 125 and rung unit connectors 175 may be secured together using clamps, brackets, clips, straps, bags, or boxes.

The hybrid ladders exemplified in the present disclosure may have additional features that may not be exemplified in the figures. For example, the hybrid ladder may have a variety of decorative features, such as logos, markings, colors, patterns, transparencies, or textures. The hybrid ladder may further include features that improve the stability and ergonomics of the device, such as grips, pads, adjustable "feet," or hand grips. The hybrid ladder of the present disclosure may be used in combination with other devices to improve the audiovisual appearance of the device, such as lights, reflective tape, sounds, timers, or beepers. The hybrid ladder of the present disclosure may additionally be used in combination with other agility and strength training devices, such as cones, balls, training apps, motion sensing devices, or other agility ladders. A plurality of hybrid ladders of the present disclosure may be used simultaneously.

The hybrid ladder of the present disclosure may be used for agility and strength training of at least one user. A user may run drills while the hybrid ladder is in a first configuration, and then the user may re-configure the hybrid ladder to a second configuration for a different set of drills. Multiple users may use the hybrid ladder at the same time, and a single user may use more than one hybrid ladder for a single drill. A user may use the hybrid ladder of the present disclosure with any combination of other items known to one of ordinary skill.

It will be appreciated that although some Figures (e.g., FIGS. 1, 4-5, 7A-7B, and 11) depict rung units having elevated rails and ground rails that have a flat cross-section and some Figures (e.g., FIGS. 2A-2B, 3, 6A-6B, 8, 9A-9B, and 10A-10B) depict rung units including elevated rails and ground rails that have I-beam cross-sections, the cross-sections can be used interchangeably between each of the embodiments disclosed herein.

This disclosure is not limited to the particular systems, methodologies or protocols described, as these may vary. The terminology used in this description is for the purpose of describing the particular versions or embodiments and is not intended to limit the scope.

In this document: (i) the term "comprising" means "including, but not limited to"; (ii) the singular forms "a," "an," and "the" include plural references unless the context clearly dictates otherwise; and (iii) unless defined otherwise, all technical and scientific terms used in this document have the same meanings as commonly understood by one of ordinary skill in the art. Also, terms such as "top" and "bottom", "above" and "below", "elevated", and other terms describing position are intended to have their relative meanings rather than their absolute meanings with respect to ground. For example, one structure may be "above" or "elevated with respect to" a second structure if the two structures are side by side with respect to the a plane, and the first structure appears to cover or be above the second structure from the point of view of a viewer (i.e., the viewer could be closer to the first structure).

As used herein, the term "about" means plus or minus 10% of the numerical value of the number with which it is being used. Therefore, about 50% means in the range of 45%-55%.

As used herein, "integrated" refers to two parts being formed as one unit, such as a ground rail and an elevated rail may be formed as a single unit, or the whole rung unit may be formed as a single unit.

As used herein, the terms "exemplary" and "exemplified" are intended to mean "by way of example" and "shown by way of example," and are not intended to specifically identify any preferred feature.

The described features, structures, or characteristics may be combined in any suitable manner in one or more embodiments. In the following description, numerous specific details are provided, such as examples of agents, to provide a thorough understanding of the disclosed embodiments. One skilled in the relevant art will recognize, however, that the embodiments can be practiced without one or more of the specific details, or with other methods, components, materials, etc. In other embodiments, well-known structures, materials, or operations are not shown or described in detail to avoid obscuring aspects of the embodiments.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A hybrid fitness ladder comprising:

a plurality of separable and nestable rung units, each comprising:

a plurality of elevated rails, a plurality of ground rails, wherein each ground rail is integrated with or connected to at least one of the elevated rails such that when the elevated rails are connected to the ground rails to form the rung units, the rung units are nestable in a stacked configuration; and at least one rung unit connector having a first end and a second end, wherein:

the first end of each rung unit connector is configured to separably connect to a respective first one of the plurality of rung units, and the second end of each rung unit connector is configured to separably connect to a respective next one of the plurality of rung units.

2. The hybrid fitness ladder of claim 1, wherein an elevated rail of the plurality of elevated rails comprises:

a first support member;

a second support member; and an elongated portion that extends between the first support member and the second support member, wherein the elongated portion is supported in an elevated position by the first support member and the second support member.

3. The hybrid fitness ladder of claim 2, wherein a ground rail of the plurality of ground rails comprises:

a first end;

a second end; and an elongated portion that extends between the first end and the second end of the ground rail, wherein at least a portion of the elongated portion of the ground rail is configured to contact a surface on which the hybrid fitness ladder is positioned.

4. The hybrid fitness ladder of claim 1, wherein:

the plurality of elevated rails of each rung unit comprise a first elevated rail and a second elevated rail;

the plurality of ground rails of each rung unit comprise a first ground rail and a second ground rail;

the first and second elevated rails of each rung unit are substantially parallel to each other and define a first and second side of the rung unit; and the first and second ground rails of each rung unit are substantially parallel to each other and define a third and a fourth side of the rung unit.

5. The hybrid fitness ladder of claim 1, wherein, for each rung unit:

the plurality of elevated rails of the rung unit comprise a first elevated rail and a second elevated rail;

the plurality of ground rails of the rung unit comprise a first ground rail and a second ground rail;

the first support member of the first elevated rail is connected to a first end of the first ground rail to form a first corner of the rung unit;

the second support member of the first elevated rail is connected to a first end of the second ground rail to form a second corner of the rung unit;

the first support member of the second elevated rail is connected to a second end of the first ground rail to form a third corner of the rung unit; and the second support member of the second elevated rail is connected to a second end of the second ground rail to form a fourth corner of the rung unit.

6. The hybrid fitness ladder of claim 1, wherein each rung unit further comprises a plurality of fastener elements, each of which is configured to attach to any of the rung unit connectors.

7. The hybrid fitness ladder of claim 6, wherein each of the rung unit connectors is configured to removably and rotatably connect to at least one of the plurality of rung units.

8. The hybrid fitness ladder of claim 7, wherein:

a first of the rung units is connected to a second of the rung units by two of the rung unit connectors;

the two rung unit connectors connect to the first rung unit at different corners of a same side of the first rung unit; and the two rung unit connectors connect to the second rung unit at different corners of a same side of the second rung unit.

9. The hybrid fitness ladder of claim 1, wherein a plurality of the rung units are connected in series, with two rung unit connectors positioned between each pair of rung units of the plurality of rung units.

10. The hybrid fitness ladder of claim 1, wherein each of the plurality of elevated rails has an I-beam shaped cross-section.

11. The hybrid fitness ladder of claim 1, wherein each of the plurality of ground rails has an I-beam shaped cross-section.

12. The hybrid fitness ladder of claim 1, wherein the plurality of elevated rails and the plurality of ground rails are removably attached to one another such that the ground rails and elevated rails are reconfigurable with respect to one another.

13. A rung unit for a hybrid fitness ladder, the rung unit comprising:

a plurality of ground rails; and a plurality of elevated rails, each of which includes an elongated portion that is elevated with respect to each of the ground rails, wherein each of the ground rails is integrated with or connected to a first of the elevated rails at a first and to a second of the elevated rails at a second end, wherein the elevated rails are made of a semi-flexible material that is deformable and biased toward a configuration in which the elevated rails are supported in an elevated position; and wherein the rung units are separable and reconfigurable between a first orientation where the elevated rails of a first rung unit are parallel to the elevated rails of a second rung unit, and a second orientation where the elevated rails of the first rung unit are perpendicular to the elevated rails of the second rung unit.

14. The rung unit of claim 13, wherein each elevated rail comprises:

a first support member;

a second support member; and the elongated portion, which extends between the first end portion and the second end portion.

15. The rung unit of claim 13, wherein:

the plurality of elevated rails comprise a first elevated rail and a second elevated rail;

the plurality of ground rails comprise a first ground rail and a second ground rail;

the first and second elevated rails are substantially parallel to each other and define a first and second side of the rung unit; and the first and second ground rails are substantially parallel to each other and define a third and a fourth side of the rung unit.

16. The rung unit of claim 13, wherein each of the elevated rails comprises a first support member and a second support member that support the elongated portion in an elevated position;

the first support member of a first of the elevated rails is connected to a first end of a first of the ground rails to form a first corner of the rung unit;

the second support member of the first elevated rail is connected to the first end of a second of the ground rails to form a second corner of the rung unit;

the first support member of a second of the elevated rails is connected to a second end of the first ground rail to form a third corner of the rung unit; and the second support member of the second elevated rail is connected to a second end of the second ground rail to form a fourth corner.

17. The rung unit of claim 13, further comprising a plurality of fastener elements, each of which is configured to attach to a rung unit connector.

18. A hybrid fitness ladder comprising a plurality of the rung units of claim 13, wherein each rung unit is connected to another rung unit by at least one rung unit connector.

19. The hybrid fitness ladder of claim 18, wherein each rung unit connector is configured to removably and rotatably connect to at least one of the plurality of rung units such that either the ground rails or the elevated rails of each of the rung unit may be positioned to be rungs of the ladder.

20. The hybrid fitness ladder of claim 18, wherein:

a first rung unit is connected to a second rung unit by two rung unit connectors;

the two rung unit connectors connect the first rung unit at different corners of a same side of the first rung unit; and the two rung unit connectors connect the second rung unit at different corners of a same side of the second rung unit.

21. A hybrid fitness ladder comprising:

a plurality of rung units, each comprising:

a plurality of elevated rails, a plurality of ground rails, coupled to at least one of the elevated rails; and at least one rung unit connector coupling at least a first rung unit to a second rung unit of the plurality of rung units, wherein the rung units are separable and reconfigurable between a first orientation where the ground rails of the first rung unit are axially aligned with the ground rails of the second rung unit, and a second orientation where the ground rails of the first rung unit are axially offset from the ground rails of the second rung unit.

* * * * *